US008020866B2

(12) United States Patent
Walker et al.

(10) Patent No.: US 8,020,866 B2
(45) Date of Patent: Sep. 20, 2011

(54) GAMES OF CHANCE INCLUDING AN EVALUATION OF A PARTIAL SYMBOL COMBINATION

(75) Inventors: Jay S. Walker, Ridgefield, CT (US); James A. Jorasch, Stamford, CT (US); Peter Kim, Stamford, CT (US); Geoffrey M. Gelman, Stamford, CT (US); Andrew P. Golden, New York, NY (US); Russell Pratt Sammon, Stamford, CT (US); Norman C. Gilman, Stamford, CT (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 12/766,459

(22) Filed: Apr. 23, 2010

(65) Prior Publication Data

US 2010/0267440 A1 Oct. 21, 2010

Related U.S. Application Data

(63) Continuation of application No. 10/988,117, filed on Nov. 12, 2004, now Pat. No. 7,726,655, which is a continuation of application No. 09/602,869, filed on Jun. 23, 2000, now Pat. No. 6,877,745.

(60) Provisional application No. 60/189,218, filed on Mar. 14, 2000.

(51) Int. Cl.
*A63F 1/00* (2006.01)

(52) U.S. Cl. ..... 273/143 R; 273/274; 463/20

(58) Field of Classification Search ..... 273/193, 273/142 R, 142 J, 274, 292, 139, 143 R; 463/17, 18, 20

See application file for complete search history.

(56) References Cited

U.S. PATENT DOCUMENTS

| | | | |
|---|---|---|---|
| 3,642,287 | A | 2/1972 | Lally et al. |
| 4,448,419 | A | 5/1984 | Telnaes |
| 4,508,345 | A | 4/1985 | Okada |
| 4,643,431 | A | 2/1987 | Hilinsky |
| 4,695,053 | A | 9/1987 | Vazquez, Jr. et al. |
| 4,743,022 | A | 5/1988 | Wood |
| 5,110,129 | A | 5/1992 | Alvarez |
| 5,154,429 | A | 10/1992 | LeVasseur |
| 5,382,025 | A | 1/1995 | Sklansky et al. |
| 5,390,934 | A | 2/1995 | Grassa |
| 5,407,209 | A | 4/1995 | Prerost |
| 5,431,408 | A | 7/1995 | Adams |
| 5,454,570 | A | 10/1995 | Karal |

(Continued)

OTHER PUBLICATIONS

Office Action for U.S. Appl. No. 09/602,869, dated Sep. 28, 2001, 5 pp.

(Continued)

*Primary Examiner* — William M Pierce
(74) *Attorney, Agent, or Firm* — K&L Gates LLP

(57) ABSTRACT

A game to be modified in accordance with the invention involves a first random outcome and a second random outcome that are combined according to game rules to produce a game outcome. The game is administered by receiving a player request for a specific entry, the specific entry replacing one of the random outcomes and being selected from a finite set of possibilities not determined by chance. The requested specific entry affects the probable outcome of the game. The specific entry is combined with the remaining one of the random outcomes according to the game rules to determine the game outcome. According to one embodiment, the specific entry may be a score such as 18 which replaces the player's hand in the game of blackjack.

10 Claims, 11 Drawing Sheets

U.S. PATENT DOCUMENTS

| | | | | |
|---|---|---|---|---|
| 5,494,296 | A | 2/1996 | Grassa | |
| 5,531,440 | A | 7/1996 | Dabrowski et al. | |
| 5,531,448 | A | 7/1996 | Moody | |
| 5,538,252 | A | 7/1996 | Green | |
| 5,655,961 | A | 8/1997 | Acres et al. | |
| 5,660,391 | A | 8/1997 | Klasee | |
| 5,704,835 | A | 1/1998 | Dietz, II | |
| 5,711,525 | A | 1/1998 | Breeding | |
| 5,720,662 | A | 2/1998 | Holmes, Jr. et al. | |
| 5,732,950 | A | 3/1998 | Moody | |
| 5,816,575 | A | 10/1998 | Keller | |
| 5,820,128 | A | 10/1998 | Brunelle | |
| RE35,968 | E | 11/1998 | Prerost | |
| 5,829,750 | A | 11/1998 | Booker | |
| 5,839,730 | A | 11/1998 | Pike | |
| 5,851,147 | A | 12/1998 | Stupak et al. | |
| 5,879,007 | A | 3/1999 | Kasri | |
| 5,897,436 | A | 4/1999 | Singer et al. | |
| 5,997,002 | A | 12/1999 | Goldman | |
| 6,129,632 | A | 10/2000 | Luciano | |
| 6,234,485 | B1 | 5/2001 | Perkins | |
| 6,336,857 | B1 | 1/2002 | McBride | |
| 6,379,245 | B2 * | 4/2002 | De Keller | 463/13 |
| 6,641,477 | B1 | 11/2003 | Dietz, II | |
| 6,651,985 | B2 * | 11/2003 | Sines et al. | 273/309 |
| 6,877,745 | B1 | 4/2005 | Walker et al. | |
| 6,935,950 | B2 * | 8/2005 | Tarantino | 463/20 |
| 7,222,858 | B2 | 5/2007 | Moody | |
| 7,393,278 | B2 * | 7/2008 | Gerson et al. | 463/20 |
| 7,431,644 | B2 | 10/2008 | Moody | |
| 7,566,271 | B2 * | 7/2009 | Hostetler et al. | 463/25 |
| 7,614,948 | B2 * | 11/2009 | Saffari et al. | 463/19 |
| 7,674,178 | B2 * | 3/2010 | Baerlocher et al. | 463/27 |
| 7,690,981 | B2 * | 4/2010 | Ching et al. | 463/20 |
| 7,736,223 | B2 * | 6/2010 | Pace | 463/19 |
| 7,785,188 | B2 * | 8/2010 | Cannon | 463/20 |
| 7,824,261 | B2 * | 11/2010 | Kojima | 463/20 |
| 2005/0026667 | A1 | 2/2005 | Moody | |

OTHER PUBLICATIONS

Office Action for U.S. Appl. No. 09/602,869, dated Feb. 27, 2002, 5 pp.

Office Action for U.S. Appl. No. 09/602,869, dated Aug. 13, 2002, 4 pp.

Office Action for U.S. Appl. No. 09/602,869, dated Mar. 26, 2003, 7 pp.

Notice of Allowability for U.S. Appl. No. 09/602,869, dated Jul. 19, 2004, 1 pg.

Kim, Jae-Ha and Grochowski, John, "Winning hands frequency in three Card Poker", Chicago Sun-Times, Oct. 25, 1996, Section: WKPWKP, Eye Candy Gaming, p. 5, NC 21, NC.

Grochowski, John, "Space Quest blackjack misfires", Chicago Sun Times, Inc., Jan. 25, 1998, Section: SHO, Casino, p. 16, NC.

Grochowski, John, "Gambling without much cash", Chicago Sun Times, Oct. 10, 1999, Section: TRA, p. 1.

Website: "Atlantis—Gaming: Three Card Poker", (http //www .atlantiscasino com/tepoker htm), download date: Feb. 14, 2000.

Website: "Craps Rules & Strategies", (http //members aol com/ rou28blk/craps htm), download date: Feb. 15, 2000.

* cited by examiner

GAMES OF CHANCE INCLUDING AN EVALUATION OF A PARTIAL SYMBOL COMBINATION

PRIORITY CLAIM

This application claims is a continuation of, claims the benefit of and priority to U.S. patent application Ser. No. 10/988,117, filed on Nov. 12, 2004, which is a continuation of, claims the benefit of and priority to U.S. patent application Ser. No. 09/602,869, filed Jun. 23, 2000, which claims the benefit of and priority to U.S. Provisional Patent Application No. 60/189,218, filed on Mar. 14, 2000, the entire contents of which are incorporated herein.

FIELD

The present invention is concerned with games of chance, including slot machines and other games that are suitable for play in a casino and/or as computer video games.

BACKGROUND

In many games of chance, the game outcome is determined on the basis of two or more independent outcomes. For example, in the card game blackjack, the outcome of the game depends on comparing the respective scores of a randomly dealt player's hand (first random outcome) and a randomly dealt dealer's hand (second random outcome).

As another example, in a video poker game based on the game of draw poker, the outcome of a hand depends upon the initial, randomly dealt hand configuration (first random outcome) as well as the cards randomly drawn (second random outcome) to replace discards from the initial hand configuration.

As still another example, the outcome of a play cycle in a slot machine is determined by a combination of the respective random outcomes that correspond to the final positions of the reels of the slot machine.

Because these games involve more than one random outcome, there is more than one way that the player may lose or may suffer bad luck. For example, in blackjack, the player may lose either by "busting" (exceeding a twenty-one count in the player's hand) or by having a lower count than the dealer. If a player suffers a run of bad luck, he/she may become frustrated and cease playing the game. This is disadvantageous to the proprietor of the gaming establishment or device.

It is considered desirable from the point of view of the game proprietor to give the player more options relative to the game so that the player feels that he/she has a better opportunity to change his/her luck and therefore continue playing. Certain known modifications to popular games have attempted to provide the player with additional options. For example, in U.S. Pat. No. 5,660,391, issued to Klasee, a variation on blackjack is disclosed. According to this variation, the player places a bet on one of five possible hand outcomes, namely blackjack, twenty-one, twenty, nineteen or eighteen. Four cards are dealt and using those cards the best ranking blackjack hand is assembled. If the resulting hand matches the player's bet, then the player wins.

According to another known variation on blackjack, casinos issue promotional coupons that may be presented at a blackjack table as a "free ace" to form part of the player's hand.

U.S. Pat. No. 4,200,291, issued to Hooker, discloses a modified slot machine in which the player can select one or two of the slot machine reels to be held at the same position at which the reels ended the previous play cycle and which was randomly determined. If the player exercises this option, then only one or two reels are spun in the next cycle in an attempt to match the position of the held reel or reels.

U.S. Pat. No. 6,068,552, issued May 30, 2000, entitled, "A Gaming Device and Method of Operation Thereof," and commonly assigned with this application, discloses a slot machine in which the player is allowed to customize parameters such as payouts or frequency of winning outcomes.

It is also a common practice in state-run lotteries to permit players either to specify the numbers to be played or to have the numbers chosen automatically and randomly by computer.

It would be desirable to provide improved games of chance that would encourage the player to continue playing and to attempt to change his luck in cases where a losing streak has occurred. It would also be desirable to provide improved games that are simpler and easier to play and therefore generally more attractive to players.

SUMMARY OF THE INVENTION

According to an aspect of the invention there is provided a method of administering a game, where the game involves at least a first random outcome and a second random outcome combined according to game rules to produce a game outcome, and the method includes receiving a player request for a specific entry instead of one of the random outcomes, wherein the specific entry is selected from a finite set of possibilities not determined by chance and affects a likelihood of a game outcome. The method also includes combining the specific entry and the remaining one of the random outcomes according to the game rules to determine the game outcome.

In an embodiment of the invention applied as a modification of blackjack, the specific entry is a specific score requested by the player to replace either the player's hand or dealer's hand. For example, the player may request a score of 18 to be compared against the dealer's hand, or may request that the dealer's hand be replaced with a score of 18 and that the player's hand be compared against that score. The specific entry may be requested by placing a betting chip in an appropriate circle in a blackjack table to indicate that the player is requesting the specific entry. As an alternative, the specific entry may be represented by a game piece, such as a plastic item bearing the indicia "18" to indicate that the player has "bought" a player's hand score of 18.

As understood from examples mentioned above, it is contemplated to practice the invention in the environment of a casino. It is also contemplated to practice the invention in video gaming devices and/or by means of gaming sites maintained on the Internet.

The present invention may be applied to the game of draw poker, by allowing the player to request a specific entry in the form of an initial configuration of the player's hand. That is, the player is permitted in this embodiment to request the five specific cards which would replace the initial hand ordinarily dealt in draw poker. Alternatively, the player may be permitted to request a particular opening hand suitable for drawing to a target hand. If the target hand, for example, is a royal flush, the player may be permitted to request ace, king, queen, jack of the same suit, plus possibly a low card (for discard) from another suit.

The present invention may also be applied to a slot machine, or more preferably to a video representation of a slot machine, by allowing the player to specify the final positions of one or more reels of the slot machine. Assume that a player wishes only to play for a relatively large payout and that the largest payout is provided by a game outcome of three 7's. The player may then be permitted to specify "7" as the final position for two reels, with the final position of a third reel to be determined randomly.

Another aspect of the invention provides an apparatus for administering a game, where the game involves a first random outcome and a second random outcome combined according to game rules to produce a game outcome, and the apparatus includes a processor, an input device connected to the processor, a display connected to the processor and a memory connected to the processor and storing a program. According to this aspect of the invention, the processor is operative with the program to receive a player request for a specific entry, where the specific entry replaces one of the random outcomes, the specific entry being such as to affect a likelihood of a game outcome and being selected from a finite set of possibilities not determined by chance. The processor is also operative to combine the specific entry and a remaining one of the random outcomes according to the game rules to produce the game outcome. The input device and the display may be connected to the processor via the Internet or may be contained in a housing together with the processor and the memory. The input device may include push buttons on a video game machine which includes the processor and the other components, or may be implemented via a graphical user interface of a personal computer or an information appliance programmed to function as a gaming terminal in communication with a gaming website.

A further aspect of the invention provides a method of playing a game of twenty-one, including the steps of allowing a player to select a specific count value instead of a player's hand, dealing and playing a dealer's hand, and comparing the specific count value to the dealer's hand to determine the winner of the game.

According to still another aspect of the invention, a method of playing a poker game includes allowing a player to select an initial hand that has not been determined by chance, allowing the player to draw at least one additional card to complete the hand, and determining whether the completed hand matches a target hand. It is contemplated to practice this aspect of the invention by using a video game device, or in conjunction with a video gaming website.

Yet another aspect of the invention provides a method of operating a slot machine (which may be a virtual or video representation of a slot machine), the method including allowing a player to specify a final position of at least one reel (which may be a virtual reel), the final position not being predetermined by chance, and the method further including the step of spinning at least one other reel of the slot machine to determine an outcome of a play cycle. According to one embodiment, the slot machine, whether or not virtual, has only three reels, and the player is allowed to specify respective positions of two of the reels, with only the third reel being spun.

By modifying known games to permit a player to select specific entries, the present invention makes the games more attractive to players. The present invention gives players a greater sense of control over the game and a feeling that the player can change his/her luck, or at least escape from a run of a certain kind of bad luck or from a continued term of bad luck. As a result, players may continue playing, rather than becoming discouraged, so that proprietors of the game benefit from more continuous and predictable play activity by the players. Furthermore, the initial player bet, the game outcome payout, and/or a fee for a specific entry may be adjusted so that the proprietor of the game is compensated for at least a part of a potential advantage that would otherwise accrue to the player as a result of the specific entry requested by the player.

It is contemplated to apply the present invention to any game of chance having two or more random outcomes, including the games of craps and pai gow in addition to other games referred to above.

DETAILED DESCRIPTION

The following definitions shall apply in this specification and in the appended claims:

client device: Includes a personal computer, portable computer, palm top device, cellular telephone, personal digital assistant or any other device programmed with a browser program or other program to interact as a client relative to a host computer.

game indicia: Includes playing cards, indicia on the reels of a slot machine, video representations of playing cards and slot machine reel indicia on a lottery card, indicia on a face of a die, and indicia on pai gow tiles.

game outcome: A determination as to whether a player has won or lost a game; may also include a determination as to an amount of a payout and/or what is to be done with an initial bet.

position: A position of a reel may include either a position of a mechanical reel or an indicia displayed on a video screen and representative of a reel position.

random outcome: One or more game indicia produced by a random or pseudo-random process; in the game of blackjack "random outcome" refers only to a complete player's hand or a complete dealer's hand or an additionally drawn card.

reel: A reel of a slot machine may include either an actual mechanical reel or a field in a video display representative of a slot machine reel.

slot machine: May include a slot machine having mechanical reels controlled by a processing device, a video slot machine, a computer programmed to simulate a slot machine, and a web server that interacts with a client device to display a slot machine simulation on the client device.

specific entry: A score, or set of one or more game indicia, specified by a player to replace a random outcome.

Figure 1:
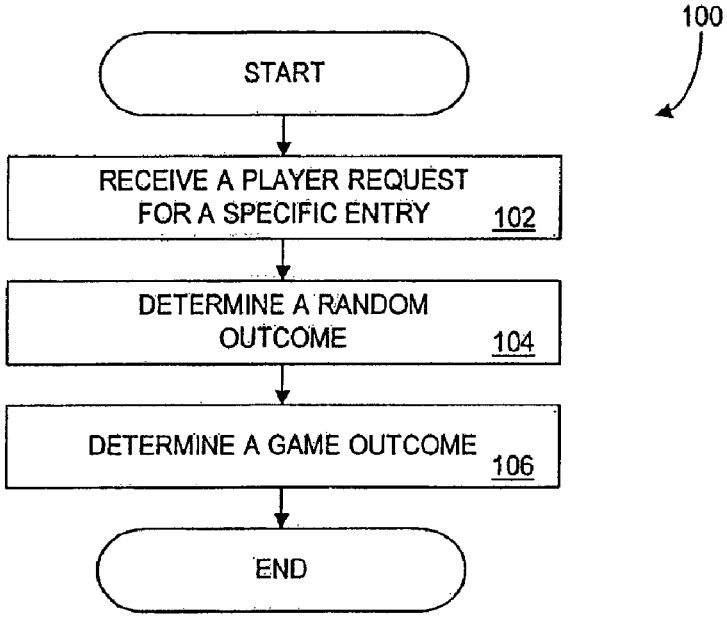
FIG. 1 is a flow chart that provides an overview of a method of administering a game in accordance with an aspect of the present invention.

FIG. 1 is a flow chart that provides an overview illustration of a method 100 provided in accordance with the present invention. According to a first step 102 in FIG. 1, a request is received from a player for a specific entry in a game of chance. The effect of the specific entry is to eliminate at least one random outcome and to limit, but not to exclude, the effect of chance on the outcome of the game. As one example of a specific entry that may be requested by a player, in the game of blackjack, according to an embodiment of the invention, the player is permitted to have a predetermined score, such as 18, instead of a player's hand.

At step 104 a random outcome is determined. In the blackjack example mentioned just above, the random outcome would be dealing and playing of the dealer's hand.

At step 106, the game outcome is determined. That is, it is determined whether the player has won or lost. In the blackjack example discussed above, the playing of the dealer's hand results in a score which is compared with the predetermined score requested by the player as a specific entry. If the score provided by the specific entry is higher than the score which results from the dealer's hand (random outcome) then the game rules prescribe that the player wins. However, if the score obtained from the dealer's hand is higher than the specific entry, then the dealer wins. In accordance with conventional practice in blackjack, a tie score results in a "push" or draw, in which the player's bet is returned to the player and the player does not win.

Figure 2:
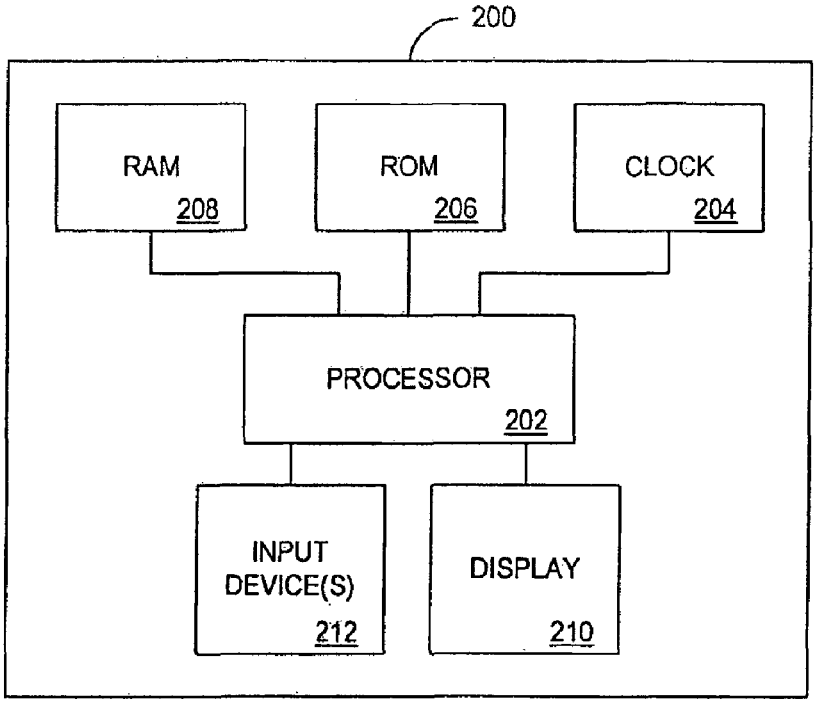
FIG. 2 is a schematic block diagram of a video game device in which aspects of the present invention may be applied.

FIG. 2 is a schematic representation of a video game device 200 in which the present invention may be applied. The electronic components and other hardware which constitute the device 200 may be the same as for known video game devices, including those which are used for video poker or video blackjack, or devices which simulate a slot machine by using a video display. The video game device 200 may include a processor 202 that controls operations of the video game device 200. The processor 202 is electrically connected to a clock 204, a Read Only Memory ("ROM") 206, a Random Access Memory ("RAM") 208, a display 210 and one or more input devices 212. These components are contained in a housing 214. It should be understood that the display 210 and input devices 212 are contained in the housing 214 in a manner such that the input devices are accessible to the player and the display device is visible to the player. The input devices 212 may take the form of push buttons. Alternatively, the input devices 212 and the display 210 may be combined in the form of a touch screen (not shown).

It was noted that the hardware making up the video game device 200 may be the same as the hardware used in known devices. Other hardware arrangements may also be used. The video game device provided in accordance with this embodiment of the invention may differ from prior art devices only in regard to a program stored in ROM 206 and/or RAM 208 and used to control the operation of the processor 202. Such program controls the video game device to carry out the process illustrated in FIG. 1 and/or similar processes, which will be described in additional detail below.

Figure 3:
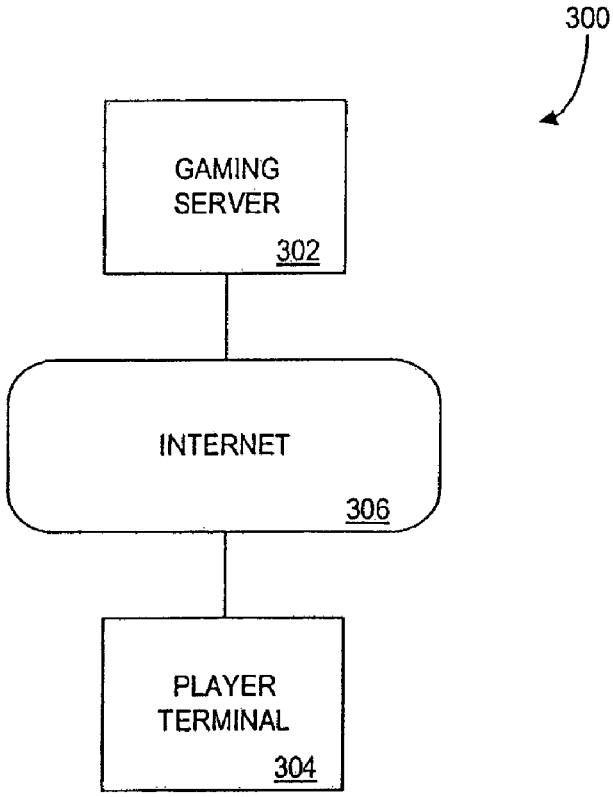
FIG. 3 is a schematic block diagram of a gaming system, implemented via the Internet, and in which aspects of the present invention may be applied.

FIG. 3 illustrates in schematic terms a system 300 for playing games of chance over a network. The system 300 includes a gaming server 302, and a player terminal 304, in data communication with each other via the Internet 306.

The gaming server 302 may be implemented using any type of hardware now in use or later developed for performing web hosting applications. The player terminal 304 may be any client device now or hereafter used to communicate over a network with a computer host. In many cases the player terminal 304 may be embodied as a conventional personal computer. Many other possible embodiments of the player terminal 304 will be recognized by those of ordinary skill in the art. The Internet 306 shown in FIG. 3 is the well known network of computers which now virtually ubiquitously enables data communications all over the world. Other types of data networks may be used in place of the Internet 306.

Although only one player terminal 304 is shown in FIG. 3, it will recognized that a large number of player terminals 304 may be connected to the gaming server 302 at different times and/or simultaneously.

Figure 4:
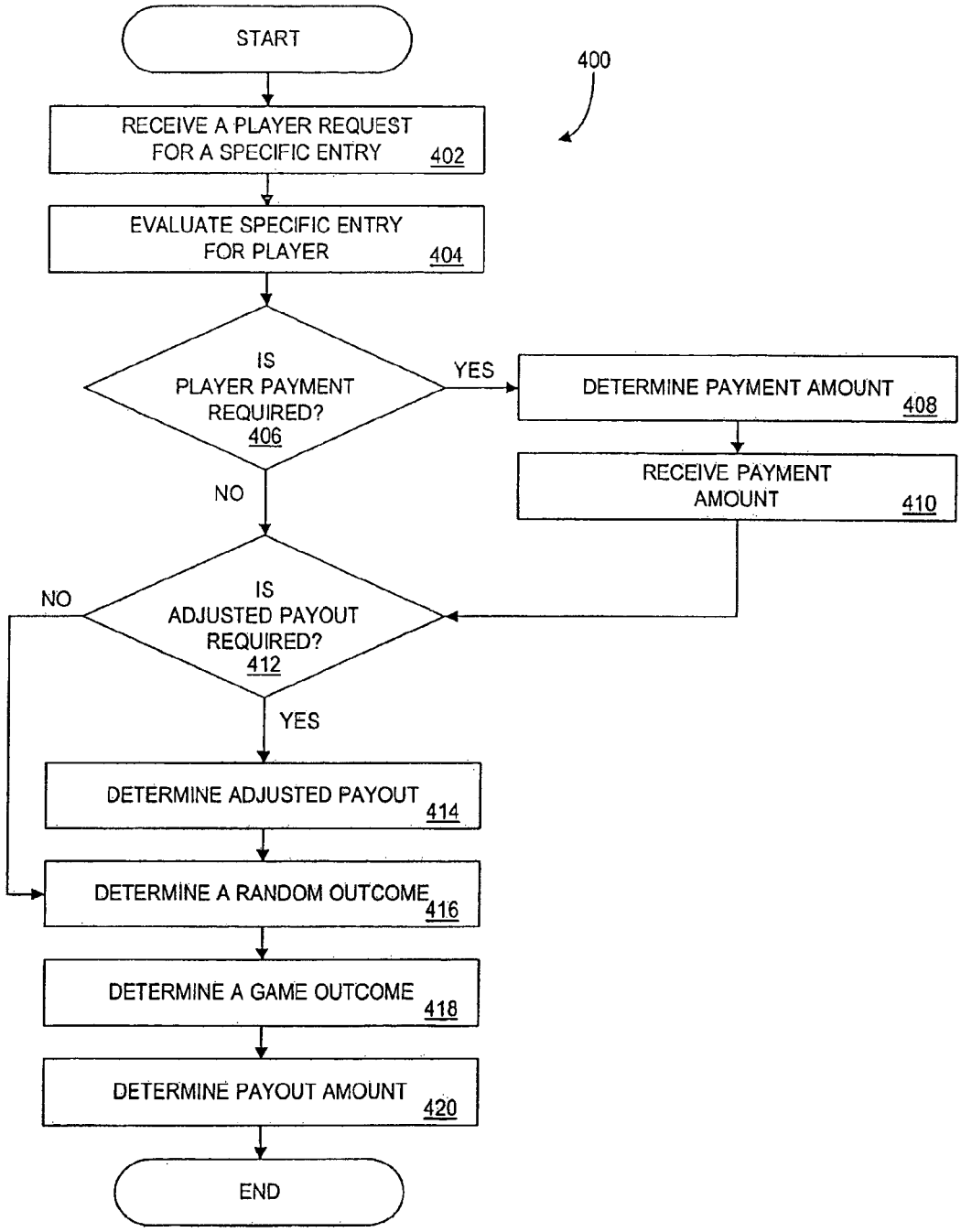
FIG. 4 is a flow chart that illustrates a method of carrying out the present invention.

FIG. 4 illustrates a process 400 that may be carried out in either video game device 200 (FIG. 2) or gaming system 300 (FIG. 3) or both. Process 400 is illustrated in more detail than the process 100 described in FIG. 1, and may accommodate a wide variety of player options in addition to those described in the blackjack example discussed in connection with FIG. 1.

According to a first step 402 in process 400, the video game device or gaming system, as the case may be, receives a player request for a specific entry. The specific entry may be, for example, a particular initial hand configuration of five cards for a game of draw poker.

Following step 402 is a step 404, at which the video game device or gaming system evaluates the requested specific entry and determines under what conditions the request is to be granted. (Although not indicated in the drawing, it is also contemplated to arrange the process 400 such that the player's request for a specific entry may be refused.) A decision block 406 follows step 404. At decision block 406 it is determined whether the specific entry requested by the player calls for an additional payment (e.g. a higher bet than a normal bet for the game). For example, in the blackjack example referred to above, the player may be permitted to request a score of 19 instead of his/her hand if the player makes a larger than normal bet of a predetermined amount. For this example, it may be assumed that a suitable rule or rules to enforce this requirement is stored in the video game device or gaming system.

If the rule indicates that an additional payment is required, then step 408 follows decision block 406. At step 408 it is determined, in accordance with the rule, what amount of payment is required. Then, at step 410, the required amount of payment is received from the player. This may be done by deducting the payment amount (e.g. enhanced bet) from a store of credits that the player has in the video game device or gaming system.

A decision block 412 follows step 410, or immediately follows decision block 406 if a negative determination is made at block 406. The purpose of decision block 412 is to determine whether the payout for winning the game is to be adjusted because of the player's requested specific entry. Again, this determination is preferably made based on a rule or rules stored in the video game device or in the gaming system. If it is determined at block 412 that the payout is to be adjusted, then the adjustment is made at step 414.

It will be appreciated that increasing the payment or bet without adjusting the payout and adjusting the payout without increasing the bet are essentially equivalent. A third equivalent would be to increase the bet while decreasing the payout. In any one of these cases, the change in the balance between bet and payout is made to offset any advantage that accrues to the player as a result of the specific entry requested by the player. As another alternative, the balance between bet and payout may remain unaltered but a specific entry may be granted to the player in consideration of the player making a sufficiently large bet on a particular game or play cycle.

It should be noted that specific entries requested by the player can be categorized at least in three ways, as those that benefit the player, as those that are substantially neutral, and as those that disadvantage the player. In some embodiments the proprietor of the game may increase the required bet and/or may reduce the payout whenever the player requests a specific entry that increases the advantage for the player. For the other two categories of specific entry, namely the substantially neutral or player-disadvantaging entries, the proprietor of the game may not either require an additional bet or may not reduce the payout.

As another alternative instead of or in addition to adjusting the bet or the payout, the odds for the remaining random outcome may be adjusted.

If the specific entry tends to provide an advantage to the player, the adjustment to the bet, to the payout, and/or to the remaining random outcome or outcomes may be arranged to (i) completely offset the advantage to the player, (ii) more than offset the advantage (i.e. increase the house advantage), or (iii) less than offset the player's advantage (i.e., allow the player to improve his/her position with the specific entry).

Step 416 follows step 414, or directly follows decision block 412 in the event that a negative determination is made at block 412. At step 416 the gaming system or video game device determines a random outcome. In the case of the blackjack example, the determination of the random outcome consists of dealing (or virtually dealing) the dealer's hand.

Following step 416 is step 418, at which the game outcome is determined. In the blackjack example, this is done by comparing the score for the dealer's hand with the specific score of 18 requested by the player.

Then, at step 420, the amount of payout, if any, is determined. Reverting again to the blackjack example, and assuming that the result of step 418 favors the player, and further assuming that there was no adjustment to the payout, step 420 would result in the player being paid an amount equal to his/her bet.

Although FIG. 4 shows decision block 412 and step 414 as preceding steps 416 and 418, it is also contemplated in other embodiments to modify process 400 such that block 412 and step 414 are performed after step 418 (i.e., after it is determined whether any payout is required). As will be understood from subsequent discussion, process 400 may also contain a determination as to whether the player is qualified to receive a specific entry. If the player satisfies certain qualification criteria, then any otherwise required adjustment in payout or enhanced bet may be waived. Alternatively, meeting qualification criteria may be a necessary condition for receiving a specific entry, with an adjustment to payout and/or enhanced bet also being required.

Up to this point the process 400 has primarily been explained in relation to embodiments in a video game device or in an Internet gaming system. It is, however, also contemplated to apply the process 400 in a face-to-face casino environment. In that regard, FIG. 5 is a plan-view illustration of an embodiment of a blackjack table that has been adapted for convenient playing of a modified blackjack game provided in accordance with the invention.

Figure 5:
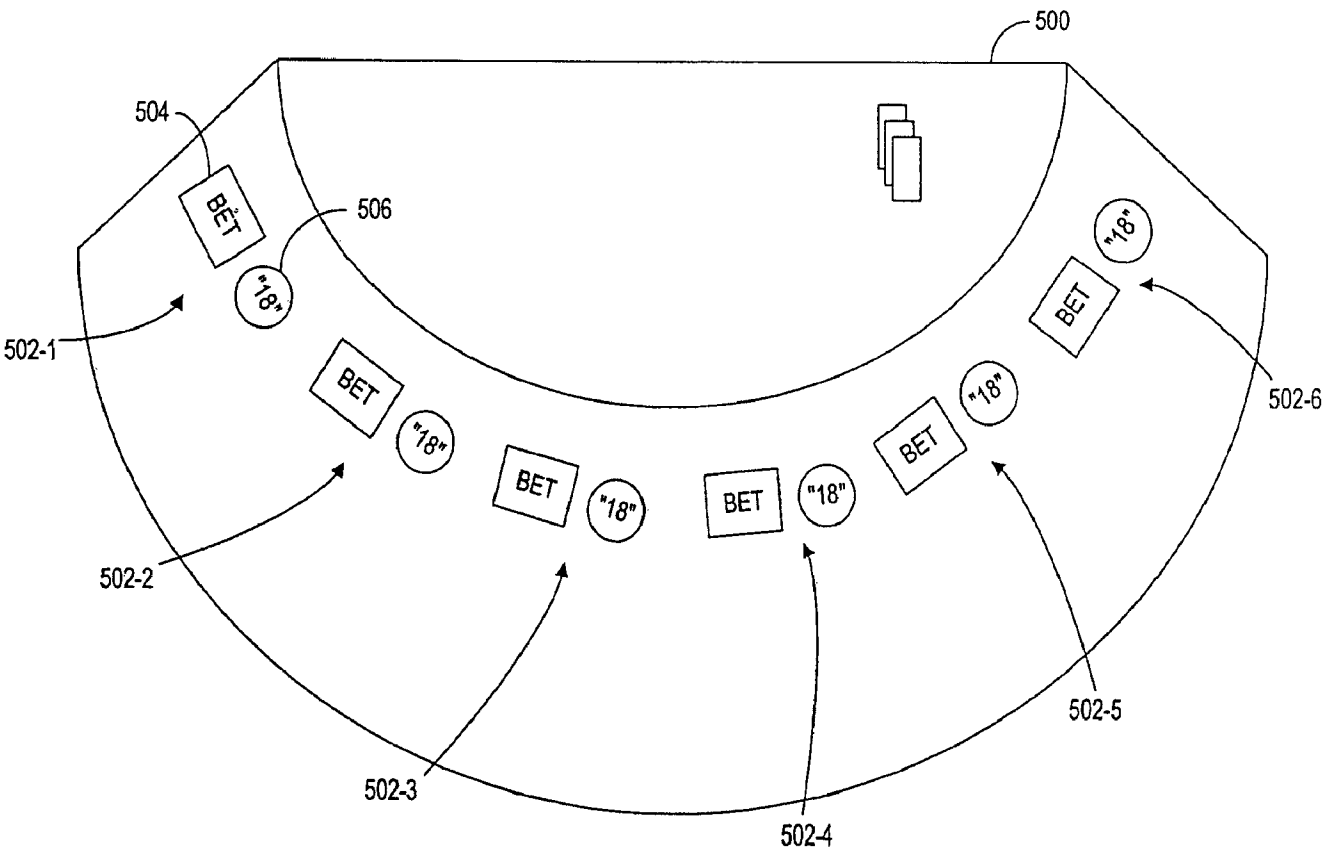
FIG. 5 is a schematic plan view of a gaming table adapted for use with an aspect of the present invention.

FIG. 5 shows a table surface 500 that has six places 502-1 through 502-5, each of the places 502 being for a respective player. Each place 502 includes a "bet" gaming chip placement area 504 and an exemplary "18" gaming chip placement area 506.

During play, the player places a chip or chips representing his/her bet in the bet area 504 if he/she wishes to play a conventional hand of blackjack. But if the player places his/her bet in the "18" area 506, then this signifies that the player is requesting a score of 18 to replace the player's hand that would otherwise be dealt in the conventional game of blackjack. The player may place a bet in each of the areas 504 and 506 to play a "free 18" hand and a conventional hand simultaneously.

Figure 6:
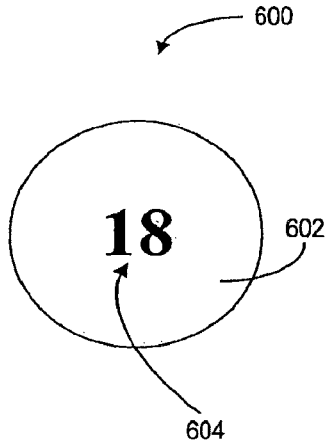
FIG. 6 is a perspective view of a laminated plastic game piece used in accordance with an embodiment of the present invention.

According to another manner of implementing the invention at a face-to-face blackjack table, laminated plastic game pieces may be provided at the table to represent specific entries that the players may request. Once such game piece, representing a request for a score of 18 to replace the player's hand, is indicated at 600 in FIG. 6. The game piece 600 includes a front surface 602 on which an indicia 604 is provided to indicate the specific score requested by the player. The game piece 600 also has a reverse face (not shown) which may set forth requirements for the specific entry represented on the front surface. These requirements may include a required bet and/or a required modification of a payout for winning the game. Although only an "18" game piece is illustrated in the drawings, it is also contemplated to provide game pieces for other specific scores, such as 17, 19 or 20. It is contemplated that several game pieces representing various scores may be kept on hand at the blackjack table, awaiting requests from players. Other types of game pieces may be used in embodiments of the invention for other table games.

It is also contemplated to use an electronic device or display to indicate that the player has received an "18" or other specific entry.

It has been noted above that the present invention may be applied to blackjack by allowing a player to request a specific entry in place of the dealer's hand. This may also be done in the context of a physical casino blackjack table. The specific entry for the dealer's hand may be applicable only to the player who requests it, or may be applicable to all the players at the table. In the latter case, all of the players may be required to make a suitable payment in addition to their bets.

The present invention also contemplates modifying the game of blackjack by allowing the player to request a partial specific entry to replace a portion of the player's hand. For example, a player may be allowed to request a score of 11 to replace the initial two cards of the player's hand. The player would then be allowed to draw a card or cards to the 11 partial specific entry. This modification is different from the prior art practice of treating a coupon as a free ace, in that the presentation would support "doubling down." As is known to those who are skilled in the art, doubling down occurs when the player doubles his/her bet after seeing the dealer's up card. When the player doubles down, he/she agrees to ask for no more than one "hit" card. Also the present modification is different from the prior art "free ace" in that the partial score of 11 replaces two cards instead of one, so that the dealer's hand is dealt immediately after the player receives the partial score of 11. Also, the present modification would not allow for the player to receive a blackjack. It is contemplated that a suitable modification in the bet and/or the payout would be required for the player to receive the partial score of 11 in accordance with this variation of blackjack provided in accordance with an aspect of the invention It is also contemplated to apply the present invention to video poker games. As is known, video poker can be played on a dedicated video game device or via a gaming system implemented through the Internet.

Figure 7:
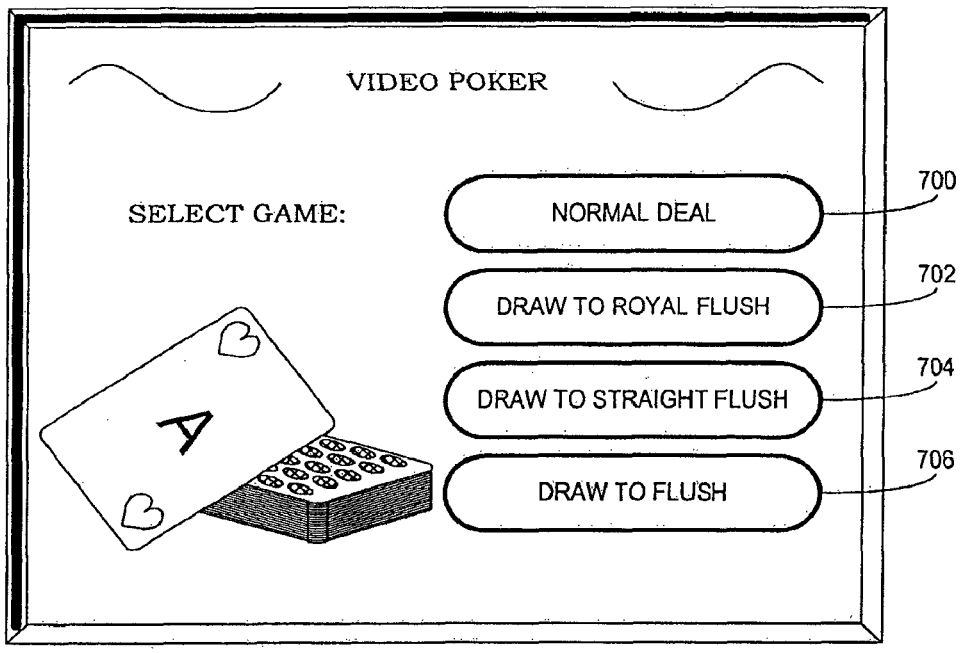
FIG. 7 illustrates a display screen provided in accordance with another aspect of the invention.

FIG. 7 represents a video display screen provided in accordance with an aspect of the invention to allow the player to request specific entries as an alternative to a conventional randomly dealt starting hand for a draw poker game. In the display screen of FIG. 7, a "normal deal" button 700 is provided to allow the player to select a conventional draw video poker game. As is well known, in the conventional draw video poker game, five cards are initially randomly dealt. The player is then permitted to discard any or all of the initial hand configuration in order to receive a "draw" of replacement cards for the discarded cards. The resulting final hand is then compared with a payout table to determine whether the player has won, and if so how much the payout is. In one example, a payout table may return a payout, at increasing odds, for hands having the following ranks: pair of jacks or better, two pair, three of a kind, straight, flush, full house, four of a kind, straight flush and royal flush.

Additional buttons 702, 704 and 706 are provided in the display of FIG. 7 to permit the user to replace the normal deal with a specific entry initial hand configuration corresponding to the respective button selected by the player. (It will be understood that the buttons may be selected via a mouse or other pointing device of a player terminal 304 (FIG. 3) if the invention is implemented via an Internet gaming system, or by a suitable input device such as a touch screen, if the invention is implemented in a video game device.)

If one of the buttons 702-706 is actuated, then an initial, non-random hand is dealt to allow the player to draw for a particular target hand indicated on the button. For instance, in the case of button 702, "Draw to Royal Flush", ace, king, queen and jack of a single suit, plus another card of a different suit may be dealt automatically in response to actuation of the button 702. This initial hand configuration constitutes a specific entry replacing the random outcome of the normal deal provided in the conventional draw poker game. Then the fifth card is automatically discarded and another card is randomly drawn to determine whether a royal flush is achieved. If so, a payout at suitable odds is provided. Otherwise, the player loses his bet, but is free to play the same game again or to select another one of the buttons 700, 704, 706. It is believed that many players may find it preferable to play repeatedly a "Draw to Royal Flush" game, having a relatively high payout, instead of the conventional video draw poker game with its more frequent but usually lower payouts.

Similarly, if button 704 ("Draw to Straight Flush") is actuated, four cards in sequence in a single suit (but not ace, king, queen, jack) are dealt, plus a fifth card, to provide the specific entry. Then, as before, the fifth card is discarded and another card is randomly drawn to determine whether the straight flush is completed. A lower payout might be provided in this case.

As to the "Draw to Flush" button 706, those of ordinary skill will now recognize the nature of an appropriate specific initial configuration of a hand to be dealt in response to actuation of button 706.

Figure 8:
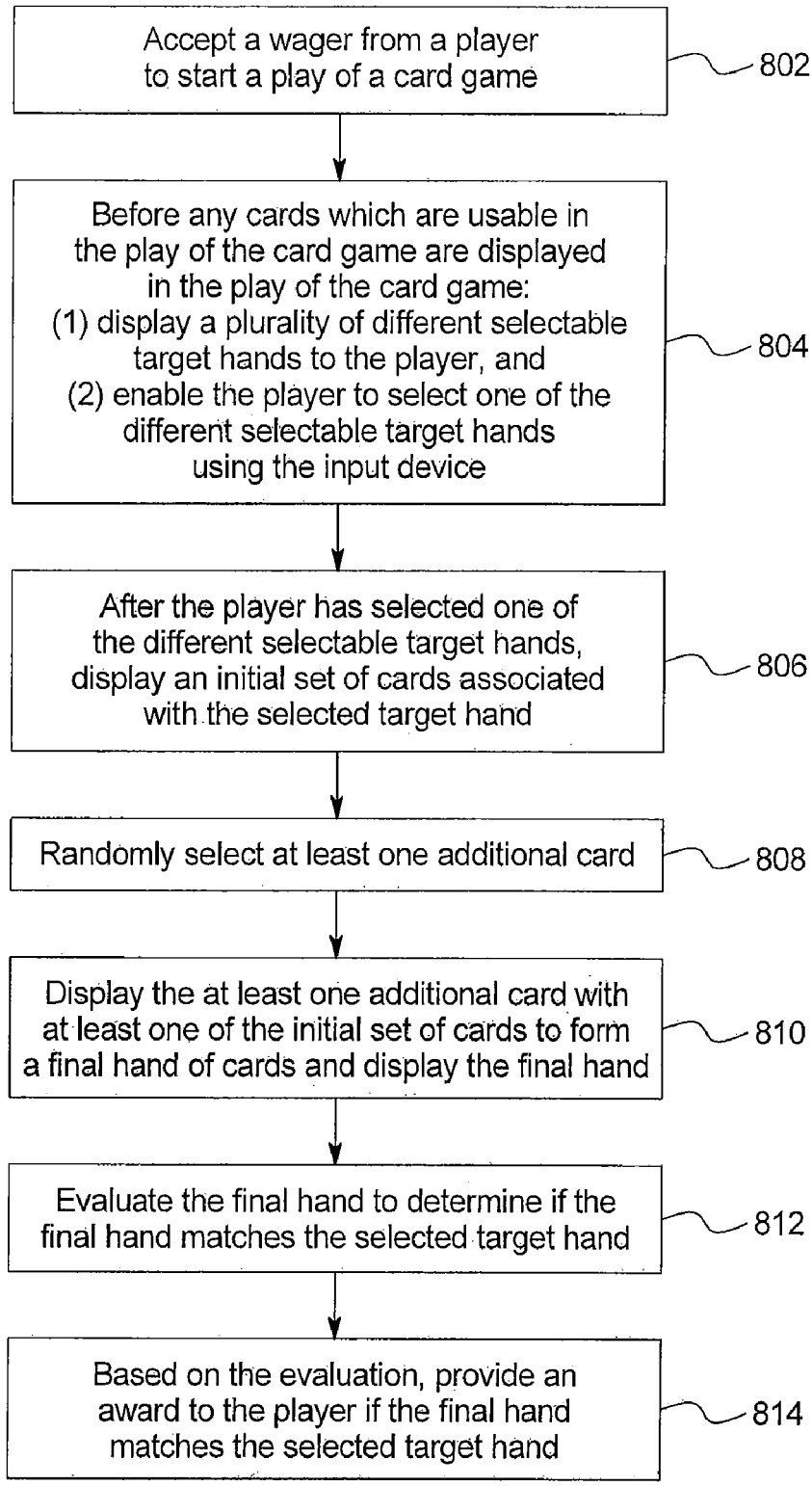
FIG. 8 is a flowchart that illustrates one method of carrying out the present disclosure.

In one example embodiment, as illustrated in FIG. 8, a wager is accepted from a player to start a play of a card game as indicated in block 802. As seen in block 804, before any cards which are usable in the play of the card game are displayed in the play of the card game: (1) a plurality of different selectable target hands are displayed to the player; and (2) the player is enabled to select one of the different selectable target hands using the input device. As seen in blocks 806 and 808, after the player has selected one of the different selectable target hands, an initial set of cards associated with the selected target hand is displayed and at least one additional card is randomly selected. As seen in block 810, the at least one additional card with at least one of the initial set of cards is displayed to form a final hand of cards and the final hand is displayed. As indicated in blocks 812 and 814, the final hand is evaluated to determine if the final hand matches the selected target hand and based on the evaluation, an award is provided to the player if the final hand matches the selected target hand.

Figure 9:
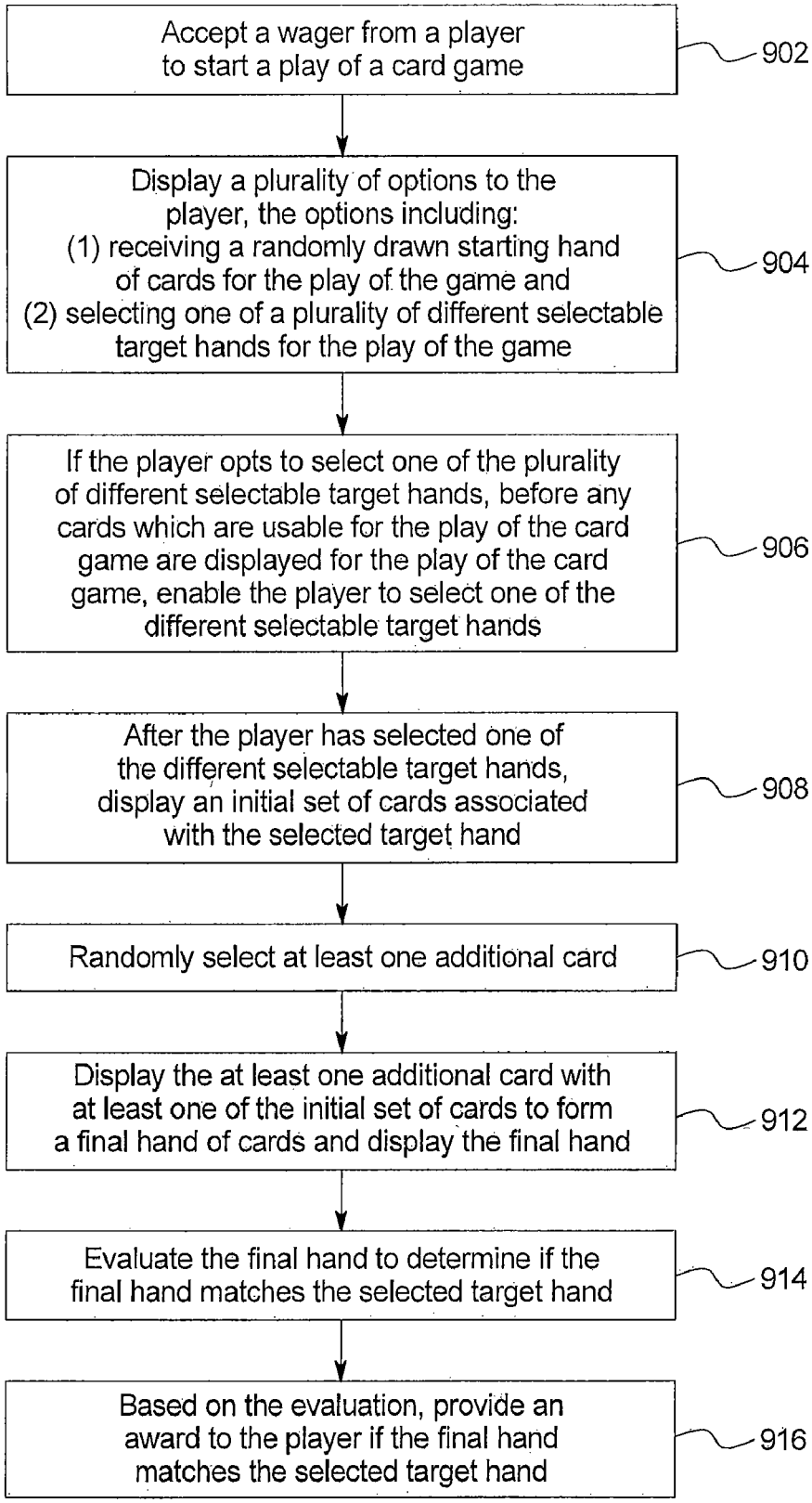
FIG. 9 is a flowchart that illustrates another method of carrying out the present disclosure.

In another example embodiment, as illustrated in FIG. 9, a wager is accepted from a player to start a play of a card game as indicated in block 902. As seen in block 904, a plurality of options are displayed to the player, the options including: (1) receiving a randomly drawn starting hand of cards for the play of the game and (2) selecting one of a plurality of different selectable target hands for the play of the game. As seen in block 906, if the player opts to select one of the plurality of different selectable target hands, before any cards which are usable for the play of the card game are displayed for the play of the card game, the player is enabled to select one of the different selectable target hands. As indicated in blocks 908 and 910, after the player has selected one of the different selectable target hands, an initial set of cards associated with the selected target hand are displayed and at least one additional card is randomly selected. As seen in block 912, the at least one additional card with at least one of the initial set of cards is displayed to form a final hand of cards and the final hand is displayed. As seen in blocks 914 and 916, the final hand is evaluated to determine if the final hand matches the selected target hand and based on the evaluation, an award is provided to the player if the final hand matches the selected target hand.

Figure 10:
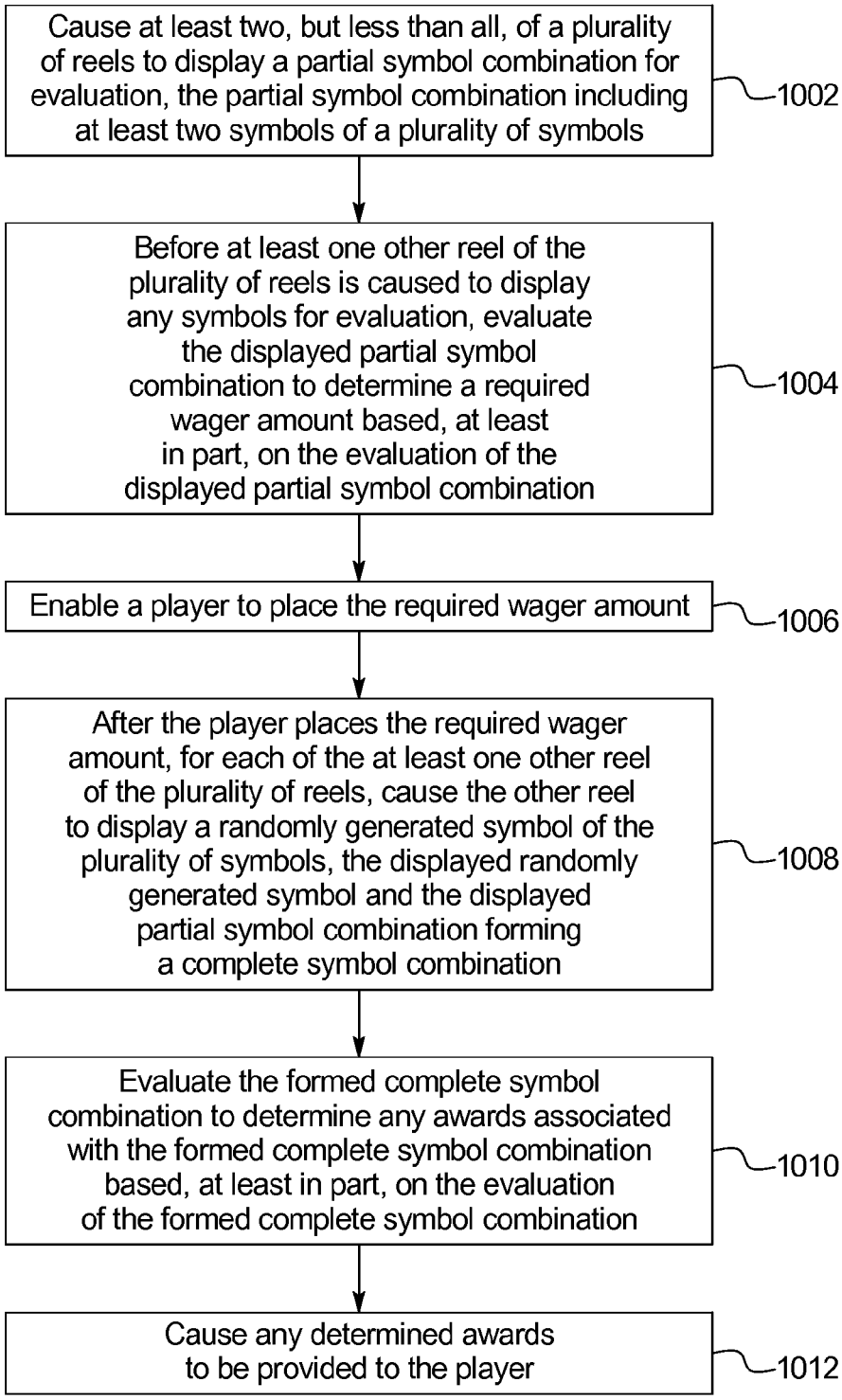
FIG. 10 is a flowchart that illustrates another method of carrying out the present disclosure.

In one example embodiment, as illustrated in FIG. 10, at least two, but less than all, of a plurality of reels are caused to display a partial symbol combination for evaluation, the partial symbol combination including at least two symbols of a plurality of symbols as indicated in block 1002. Before at least one other reel of the plurality of reels is caused to display any symbols for evaluation, the displayed partial symbol combination is evaluated to determine a required wager amount based, at least in part, on the evaluation of the displayed partial symbol combination as indicated in block 1004. A player is enabled to place the required wager amount as indicated in block 1006. After the player places the required wager amount, for each of the at least one other reel of the plurality of reels, the other reel is caused to display a randomly generated symbol of the plurality of symbols as indicated in block 1008. The displayed randomly generated symbol and the displayed partial symbol combination forming a complete symbol combination. The formed complete symbol combination is evaluated to determine any awards associated with the formed complete symbol combination based, at least on part, on the evaluation of the formed complete symbol combination as indicated in block 1010. Any determined awards are caused to be provided to the player as indicated in block 1012.

Figure 11:
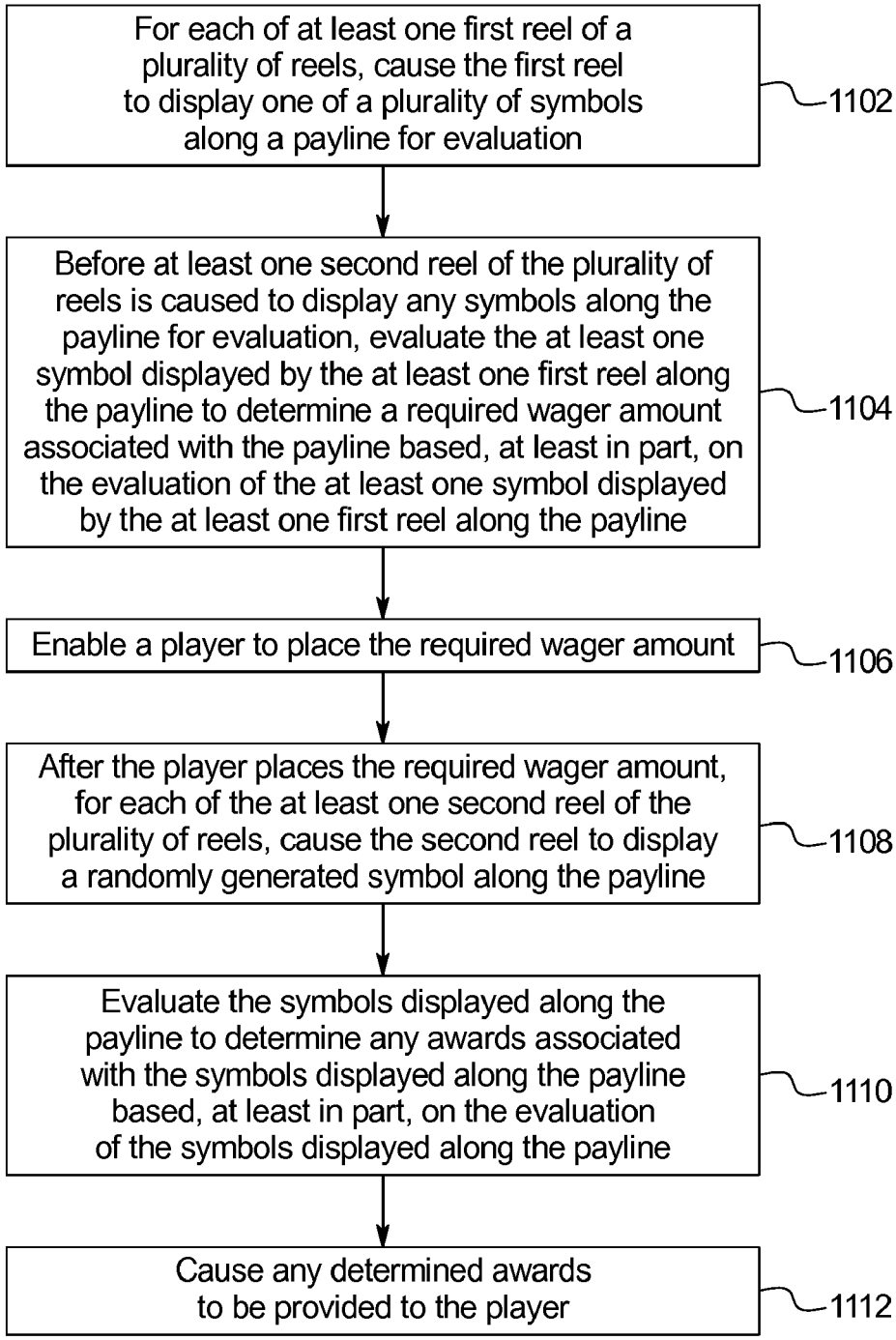
FIG. 11 is a flowchart that illustrates another method of carrying out the present disclosure.

In another example embodiment, as illustrated in FIG. 11, for each of at least one first reel of a plurality of reels, the first reel is caused to display one of a plurality of symbols along a payline for evaluation as indicated in block 1102. Before at least one second reel of the plurality of reels is caused to display any symbols along the payline for evaluation, the at least one symbol displayed by the at least one first reel along the payline is evaluated to determine a required wager amount associated with the payline based, at least in part, on the evaluation of the at least one symbol displayed by the at least one first reel along the payline as indicated in block 1104. A player is enabled to place the required wager amount as indicated in block 1106. After the player places the required wager amount, for each of the at least one second reel of the plurality of reels, the second reel is caused to display a randomly generated symbol along the payline as indicated in block 1108. The symbols displayed along the payline are evaluated to determine any awards associated with the symbols displayed along the payline based, at least in part, on the evaluation of the symbols displayed along the payline as indicated in block 1110. Any determined awards are caused to be provided to the player as indicated in block 1112.

Of course, some of the specific entry options of the embodiment of FIG. 7 may be omitted, and/or replaced or supplemented by other options, such as "Draw to Full House".

In the draw poker example described above it is contemplated that, at least in a video game or gaming system embodiment, the player may be permitted to specify any starting hand. To facilitate such an embodiment of the invention, it is contemplated to calculate in advance a suitable payout table and/or a suitable bet for every possible hand, and to store the resulting data in a lookup table to be accessed upon the player's requesting a particular hand. Alternatively, a suitable payout table and/or a suitable bet may be calculated in real time in response to the player's request for a particular hand. An appropriate user interface may be provided including five fields in which a card is to be dealt or drawn (in accordance with conventional practice), but with the addition of pull-down menus at each field for specifying the rank and suit of the card requested for the respective field. In addition, the payment and/or payout may be calculated to allow the player-specified specific entry starting hand.

There has been described above an example of requesting a specific entry in place of the initial hand in draw poker. It is further contemplated that specific entries could be requested for other varieties of poker. For example, in "Texas hold "em" poker, the player could be permitted to request a specific entry in place of the two card hand normally dealt to the player. The specific entry would take the form of two particular cards requested by the player. The bet required and/or the payout could be adjusted as appropriate based on the particular card combination requested.

Furthermore, it is contemplated to allow requests for specific entries in face-to-face poker games, as well as in video poker. In the face-to-face situation, house rules may be formulated that allow for specific entries to be granted on a player's request upon suitable conditions such as additional antes, and/or adjustments of a pot or payout among the players. The granting of a request for a specific entry in this example may be automatic upon the player agreeing to the required conditions, or may be subject to approval by the other players at the table.

In blackjack it is contemplated to permit a specific entry to be substituted for a "hit" card, and in draw poker it is contemplated to permit a specific entry to be substituted for one or more draw cards.

According to another embodiment of the invention, a player is permitted to request a specific entry in a slot machine, or in a virtual representation of a slot machine provided by a video game device or a gaming system. The specific entry that may be requested corresponds to a particular final reel position for each of one or two reels of a slot machine that has three reels. Thus, assuming the highest payout is for three sevens, the player is permitted to specify that two of the reels are positioned at seven and only the third reel is spun. A suitable modification to the payout and/or the bet may be required. Alternatively, the probability for the third reel providing a seven may be adjusted to be commensurate with the payout.

It is also contemplated that the present invention may be applied to the game of craps. For example, a player's initial throw of the dice may be replaced by a specific entry, or only one die out of the two may be replaced by a specific entry.

It has been indicated above that the granting of a specific entry may be dependent on adjusting the required bet and/or adjusting the payout for winning and/or changing the probabilities which govern the remaining random outcome. However, it is contemplated that a player may be granted a request for a specific entry for other reasons. For example, a casino may wish to encourage continued play by granting certain preferred players one or more specific entries based on the player's history of play or current rate of play or time period of play. As an example, a player who plays continuously for an hour at a blackjack table may be allowed two specific entries per hour consisting of a score for the player's hand of 19. Specific entries may also be awarded after the player has lost a certain amount of money within a given period of time, or has lost a number of hands in a row, or if the player has been exceptionally unlucky in a previous hand.

An event that qualifies a player for a specific entry may be noted by a human dealer, or may be automatically detected by a device such as a video game device or a gaming server. The device may then automatically provide to the player the option of requesting the specific entry.

A specific entry may also be granted to a player on the basis of other activities of the player, such as purchasing services or goods from the proprietor of the game or from an affiliate of the proprietor, or because the player is a newcomer to the game. It is also contemplated that specific entries may be permitted at times when relatively few players are playing a game, in order to draw new players into the game and increase traffic. Also, a specific entry may be granted in a situation where the player receiving the specific entry is faring much worse than other players at the gaming table.

With the modified games of chance provided in accordance with the invention, the player is provided with additional options to specify starting conditions of the game, thereby increasing the attractiveness of the game for the player. The options provided to the player in accordance with the invention may allow the player to overcome a perceived run of bad luck, and thus encourage the player to continue playing, to the advantage of the proprietor of the game. For example, a player who has been busting frequently in blackjack may be inclined to continue playing when he/she is allowed to request a specific entry in place of the player's hand, thereby completely eliminating any chance of going bust.

Moreover, because of player preferences and for psychological reasons players may be attracted to the opportunity to pursue certain outcomes (e.g. straights or flushes in poker) even though there is no statistical advantage in pursuing such outcomes. The present invention, by permitting requests for specific entries, allows casinos to cater to such player preferences.

Players may also find it preferable to patronize casinos that provide the option of specific entries even when the players do not avail themselves of the option. Simply having the option may favorably dispose the players to the casino.

Although the present invention has been described with respect to preferred embodiments thereof, those skilled in the art will note that various substitutions, modifications and variations may be made with respect to the embodiments described herein without departing from the spirit and scope of the present invention.

The invention is claimed as follows:

1. A gaming system comprising:

a display device;

an input device;

a processor; and a memory device which stores a plurality of instructions, which when executed by the processor, cause the processor to operate with the display device and the input device to, for a play of a game:

(a) cause at least two, but less than all, of a plurality of reels to display a partial symbol combination for evaluation, said partial symbol combination including at least two symbols of a plurality of symbols;

(b) before at least one other reel of the plurality of reels is caused to display any symbols for evaluation, evaluate the displayed partial symbol combination to determine a required wager amount based, at least in part, on said evaluation of the displayed partial symbol combination;

(c) enable a player to place the required wager amount; and (d) after the player places the required wager amount:

(i) for each of the at least one other reel of the plurality of reels, cause said other reel to display a randomly generated symbol of the plurality of symbols, said displayed randomly generated symbol and said displayed partial symbol combination forming a complete symbol combination, (ii) evaluate the formed complete symbol combination to determine any awards associated with the formed complete symbol combination based, at least on part, on said evaluation of the formed complete symbol combination, and (iii) cause any determined awards to be provided to the player.

2. The gaming system of claim 1, wherein when executed by the processor after the player places the required wager amount, the plurality of instructions cause the processor to cause a plurality of other reels of the plurality of reels to each display a randomly generated symbol of the plurality of symbols.

3. The gaming system of claim 1, wherein if a first partial symbol combination associated with a first average expected payout is displayed before the at least one other reel is caused to display any of the plurality of symbols, the plurality of instructions, when executed by the processor, cause the processor to evaluate the first partial symbol combination to determine a first required wager amount based, at least on part, on said evaluation of the first partial symbol combination, and if a second, different partial symbol combination associated with a second, greater average expected payout is displayed before the at least one other reel is caused to display any of the plurality of symbols, the plurality of instructions, when executed by the processor, cause the processor to evaluate the second, different partial symbol combination to determine a second, greater required wager amount based, at least in part, on said evaluation of the second, different partial symbol combination.

4. The gaming system of claim 1, wherein when executed by the processor before the at least one other reel is caused to display any symbols for evaluation in the play of the game, the plurality of instructions cause the processor to modify a probability of said at least one other reel displaying at least one symbol of the plurality of symbols.

5. The gaming system of claim 1, wherein when executed by the processor before the at least one other reel is caused to display any symbols for evaluation in the play of the game, the plurality of instructions cause the processor to modify a payout associated with the formed complete symbol combination.

6. A gaming system comprising:

a display device;

an input device;

a processor; and a memory device which stores a plurality of instructions, which when executed by the processor, cause the processor to operate with the display device and the input device to, for a play of a game:

(a) for each of at least one first reel of a plurality of reels, cause said first reel to display one of a plurality of symbols along a payline for evaluation;

(b) before at least one second reel of the plurality of reels is caused to display any symbols along the payline for evaluation, evaluate the at least one symbol displayed by the at least one first reel along said payline to determine a required wager amount associated with said payline based, at least in part, on said evaluation of the at least one symbol displayed by the at least one first reel along said payline;

(c) enable a player to place the required wager amount; and (d) after the player places the required wager amount:

(i) for each of the at least one second reel of the plurality of reels, cause said second reel to display a randomly generated symbol along said payline, (ii) evaluate the symbols displayed along said payline to determine any awards associated with the symbols displayed along said payline based, at least in part, on said evaluation of the symbols displayed along said payline, and (iii) cause any determined awards to be provided to the player.

7. The gaming system of claim 6, wherein when executed by the processor, the plurality of instructions cause the processor to:

(a) cause a third reel to display a randomly generated symbol along said payline before the second reel displays any symbols along the payline for evaluation in the play of the game, and (b) evaluate the symbol displayed by the third reel along said payline, wherein the required wager amount is based, at least in part, on said evaluation of the at least one symbol displayed by the first reel along said payline and the at least one symbol displayed by the third reel along said payline.

8. The gaming system of claim 6, wherein if at least a first symbol associated with a first average expected payout is displayed along said payline before the second reel is caused to display any symbols along the payline for evaluation, the plurality of instructions, when executed by the processor, cause the processor to evaluate said first symbol displayed along the payline to determine a first required wager amount based, at least on part, on said evaluation of the first symbol, and if a second, different symbol associated with a second, greater average expected payout is displayed along said payline before the second reel is caused to display any symbols along the payline for evaluation, the plurality of instructions, when executed by the processor, cause the processor to evaluate said second, different symbol displayed along the payline to determine a second, greater required wager amount based, at least on part, on said evaluation of the second, different symbol.

9. The gaming system of claim 6, wherein when executed by the processor before the second reel is caused to display any symbols along the payline for evaluation in the play of the game, the plurality of instructions cause the processor to modify a probability of said second reel displaying at least one symbol of the plurality of symbols.

10. The gaming system of claim 6, wherein when executed by the processor before the second reel is caused to display any symbols along the payline for evaluation in the play of the game, the plurality of instructions cause the processor to modify a payout associated with a plurality of displayed symbols.

* * * * *